United States Patent [19]

Gunderson et al.

[11] Patent Number: 4,608,765

[45] Date of Patent: Sep. 2, 1986

[54] PROCESS AND APPARATUS FOR SIMULATING A ROLLING AND DRYING OPERATION

[75] Inventors: Dennis E. Gunderson; John F. Hunt, both of Madison, Wis.

[73] Assignee: The United States of America as represented by the Secretary of Agriculture, Washington, D.C.

[21] Appl. No.: 473,397

[22] Filed: Mar. 8, 1983

[51] Int. Cl.[4] ..... F26B 7/00

[52] U.S. Cl. ..... 34/12; 34/18; 34/95.3; 34/89; 34/216

[58] Field of Search ..... 34/88, 89, 113, 95.3, 34/217, 236, 9, 12, 18, 216

[56] References Cited

U.S. PATENT DOCUMENTS

| | | | |
|---|---|---|---|
| 4,477,981 | 10/1984 | Chan | 34/89 |
| 4,497,121 | 2/1985 | Choinski | 34/89 |
| 4,536,971 | 8/1985 | Pulsmeier et al. | 34/89 |

*Primary Examiner*—Larry I. Schwartz

*Attorney, Agent, or Firm*—M. Howard Silverstein; David G. McConnell

[57] ABSTRACT

An operation wherein a large amount of material is passed through the nip of two rolls and a dryer at high speed using only a small specimen of material is disclosed. A low mass carrier for the specimen is provided. The carrier and specimen are quickly accelerated to the peripheral speed of the rolls and the specimen is passed through the rolls and quickly stopped inside a static dryer. Specific apparatus for carrying out each step of the operation is disclosed.

8 Claims, 9 Drawing Figures

PROCESS AND APPARATUS FOR SIMULATING A ROLLING AND DRYING OPERATION

BACKGROUND OF THE INVENTION

1. Field of the Invention

This invention relates to experimentally simulating a rolling and drying operation typically performed with large amounts of material, such as in a paper-making process. It would be helpful to be able to perform experimental simulation of the process using only a small specimen of material, instead of the large amount of material used in the commercial process.

2. Prior Art

The prior art discloses commercial operations using rolls and dryers performed on individual pieces of material. See, for example, U.S. Pat. Nos. 2,270,038 (Corbin), 2,892,735 (Curler et al), and 3,467,060 (Klebanow et al). However none of these patents is directed to simulating an operation usually performed on a large web of material (such as a roll of paper) using only a small specimen of material.

U.S. Pat. No. 2,321,939 (Quinn) discloses a process performed on a continuous web of material. This patent contains no disclosure about how the process could be simulated using only a small specimen of material.

Hence there is a need for a process and apparatus for simulating rolling and drying operations using only a small specimen of material in place of the expensive large web or roll of material used in the commercial operation.

SUMMARY OF THE INVENTION

One aspect of the invention comprises apparatus for simulating an operation wherein a large amount of material is passed through the nip of two rolls and a dryer at high speed using only a small specimen of material comprising:

(a) a low mass carrier for the specimen having a leader and a trailer thinner than the nip of the rolls, (b) means for quickly accelerating said carrier to the peripheral speed of the rolls and for pulling said specimen into the nip of the rolls, (c) a static dryer for the specimen, (d) means for quickly decelerating the specimen and carrier such that the specimen comes to rest inside said dryer, and (e) means for continuously applying spreading forces to the rolls to eliminate slack and render roll clearance constant.

DESCRIPTION OF PREFERRED EMBODIMENT

Figure 1:
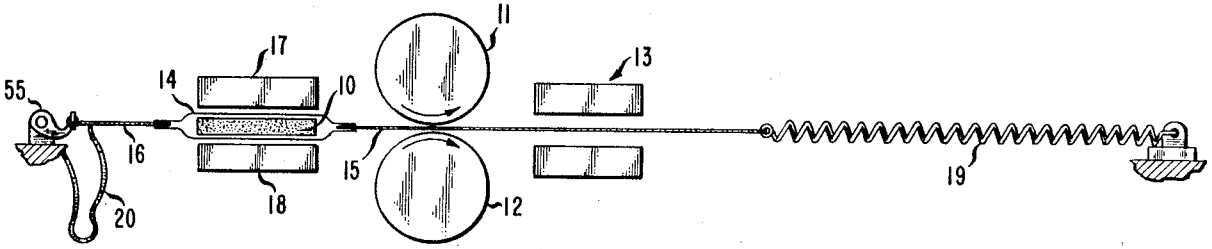
FIG. 1 is a side view of apparatus in accordance with the invention.

FIG. 1 shows apparatus in accordance with the invention for simulating a rolling and drying operation on specimen 10 of material. The specimen is to pass through the nip of rolls 11 and 12 rotating in the direction shown by the arrows and come to rest in dryer 13. Normally the operation is performed on a large continuous web of material at very high speeds. In order to pass through the rolls at high speed, the specimen must be quickly accelerated to the peripheral speed of the rolls. After passing through the nip, it must then be quickly decelerated so that it comes to rest inside of dryer 13.

To achieve such rapid acceleration, specimen 10 is carried by low mass carrier 14 having a leader 15 and a trailer 16. The carrier is preferably similar to the material used to carry the web in the commercial operation, such as wire, screen, shim stock, etc. It is important that leader 15 and trailer 16 be thin enough to pass through the nip of the rolls with clearance.

Prior to starting the simulation, the specimen may be conditioned to a desired temperature and water content with heated conditioning platens 17 and 18.

Means are provided for quickly accelerating carrier 14 and specimen 10 to the peripheral speed of rolls 11 and 12 and for pulling the specimen into the nip of the rolls. In FIG. 1, leader 15 is connected to tension spring 19, and trailer 16 is latched to latch 55. Upon release of latch 55, spring 19 quickly accelerates carrier 14 and specimen 10 to the peripheral speed of rolls 11 and 12 and pulls leader 15 through the rolls so that specimen 10 enters the nip at the same speed as a large web of material would during a commercial operation.

After passing through the rolls, the specimen enters static dryer 13, the preferred design of which is more fully described later.

Means are provided for quickly decelerating the specimen and carrier so that the specimen comes to rest inside dryer 13. In FIG. 1 loop 20, connected to trailer 16 at one end and latch 55 at its other end, is pulled tight when the specimen moves into the dryer, thereby quickly decelerating carrier 14 and specimen 10.

Since rolls 11 and 12 are subject to sudden dynamic spreading force when specimen 10 passes through the nip, the free play, inherent in all rolling machinery, must be removed, if an accurate simulation of the continuous rolling process is to be accomplished. Hence, means, not shown in FIG. 1, are provided for continuously applying spreading force to the rolls to eliminate slack and render roll clearance constant. Such means are fully described later.

Figure 2:
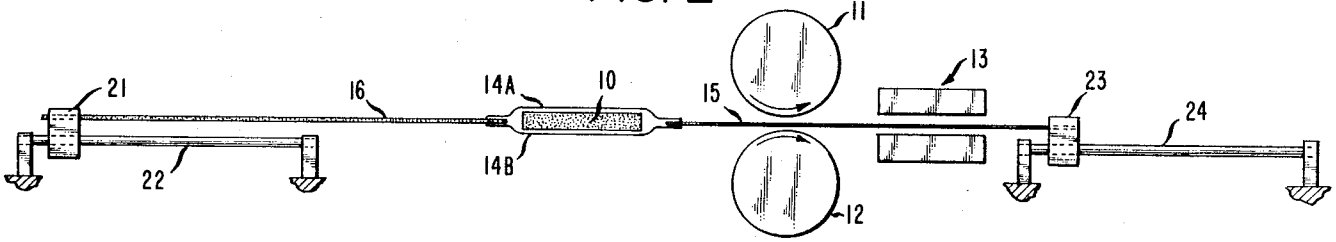
FIG. 2 is a side view of a portion of apparatus according to a preferred embodiment.

FIG. 2 is a partial view of more preferred apparatus. Here trailer 16 is connected to slide block 21, which slides on rail 22. Leader 15 is connected to slide block 23 which slides on rail 24. In this embodiment, the carrier has two web retaining members 14A and 14B, such as screens, which are attached to leader 15 and trailer 16.

Figure 3:
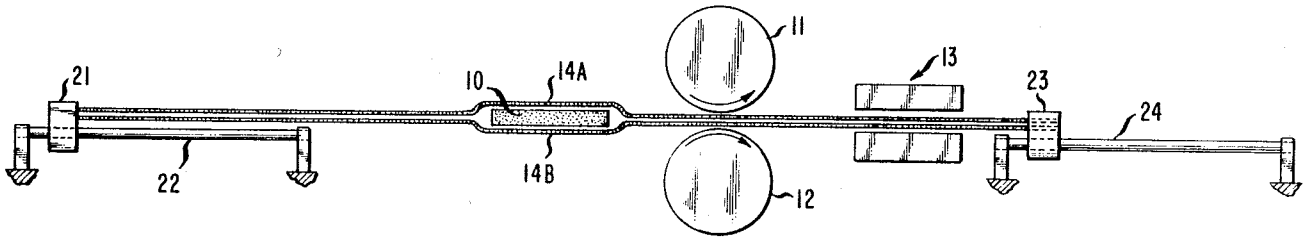
FIGS. 3, 4, and 5 illustrate different ways in which the specimen carrier can be connected to the leader and trailer.

FIG. 3 illustrates a carrier design that may be used if the nip clearance is large. Here carrier members 14A and 14B are each extended all the way to slide blocks 21 and 23, thereby forming a leader and trailer.

Figure 4:
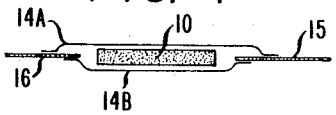

If clearance between rolls 11 and 12 is small, the leader and trailer must be very thin. FIG. 4 shows how leader 15 and trailer 16 are attached to web retaining members 14A and 14 B at locations that are staggered along the lengths of leader 15 and trailer 16 to avoid creating thicknesses greater than that of the combined thickness of specimen 10 and carrier members 14A and 14B.

Figure 5:
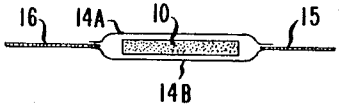

FIG. 5 shows another carrier design for close roll clearance. Here a single piece of material forms leader 15, trailer 16 and retaining member 14B. Member 14A is attached to the piece forming items 15, 16, and 14B. This arrangement results in minimum joining thicknesses.

Figure 6:
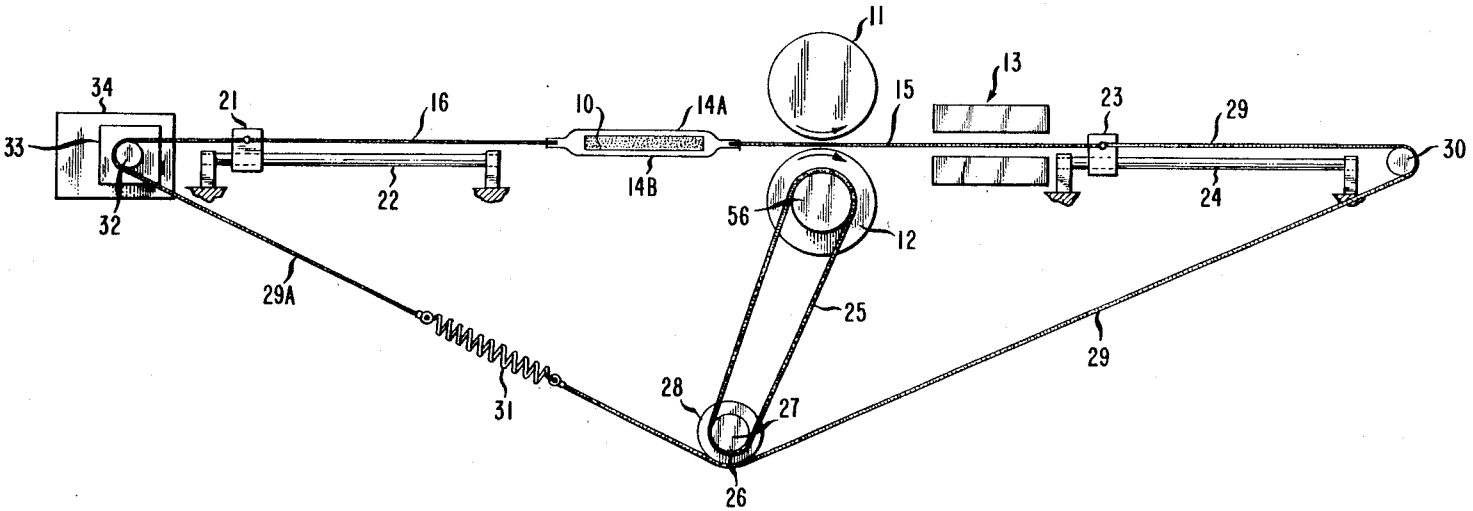
FIG. 6 is a side view schematic of complete apparatus according to a preferred embodiment.

FIG. 6 illustrates the complete apparatus only partially shown in FIG. 2. Here the carrier is quickly accelerated by a system of pulleys driven by one of the rolls. Pulley 56 mounted on roll 12 drives pulley 26 by means of belt 25. A combination clutch and brake assembly 27, well known in the art, connects pulley 26 to flat faced sheave 28, providing a means for engaging and disengaging the pulley system from roll 12. Pulleys 56 and 26 and sheave 28 are sized such that the peripheral speed of sleave 28 is the same as that of roll 12.

A cable 29 is connected to slide block 23. It passes over idler pulley 30, makes several turns around sheave 28, and is then connected to tension spring 31, which keeps the carrier and cables under tension. Another cable 29A runs from spring 31 and makes several turns around pulley 32 and is connected to slide block 21. Pulley 32 is connected to a means for measuring the movement of carrier 10 and a means for quickly decelerating the carrier. The measuring means may be a digital shaft encoder 33 and the decelerating means may be an electromagnetic brake 34.

The apparatus of FIG. 6 functions as follows. Rolls 11 and 12 are started and brought to speed causing pulley 56 to drive pulley 26 through belt 25. To accelerate the carrier and specimen to roll speed, clutch and brake assembly 27 is engaged causing pulley 26 to drive sheave 28. Sheave 28 pulls cable 29 over pulley 30, causing block 23 to move to the right in the drawing, pulling leader 15 and specimen 10 into the nip of rolls 11 and 12. Carrier members 14A and 14B pull trailer 16, which pulls block 21 to the right in the drawing. Block 21 pulls cable 29A over pulley 32, activating digital shaft encoder 33. After encoder 33 reads that the system has experienced enough movement to move specimen 10 into dryer 13, two events occur simultaneously: (1) the clutch portion of clutch and brake assembly 27 is disengaged, removing motive force from the pulley system, and (2) electromagnetic brake 34 and the brake portion of clutch and brake assembly 27 are applied to quickly halt movement of trailer 16 and specimen 10. Automatic control apparatus, well known in the art, is preferably used to carry out the above operation.

Figure 7:
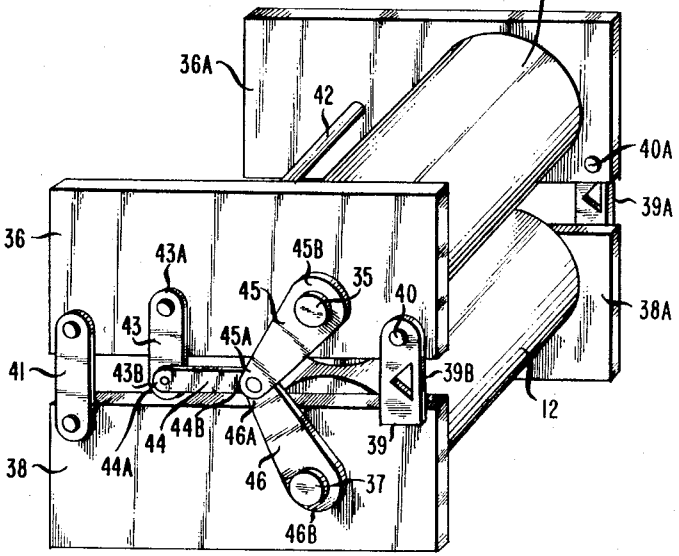
FIG. 7 is an isometric view of apparatus for continuously applying spreading forces to two rolls

As stated previously, means must be provided for continuously applying spreading force to the rolls. A preferred arrangement for this is shown in FIG. 7. Here roll 11 is mounted for rotation on shaft 35 in upper frame members 36 and 36A. Roll 12 rotates on shaft 37 in lower frame members 38 and 38A.

The upper and lower frame members are connected by pivot blocks 39 and 39A which are welded to lower frame members 38 and 38A. Upper frame members 36 and 36A pivot on pivots 40 and 40A in pivot blocks 39 and 39A.

Roll clearance is set by link 41 which attaches to the upper and lower frame members. By using links of different lengths, different roll clearances may be achieved.

Spreading force is applied to the two rolls as follows. Shaft 42 is rotatably mounted in upper frame members 36 and 36A. Arm 43 having first end 43A and second end 43B is fixedly attached to shaft 42 at first end 43A. First link 44 having first pivot 44A and second pivot 44B is rotatably mounted on second end 43B of link 43 at first pivot 44A. Second link 45 having third pivot 45A and fourth pivot 45B is provided. A third link 46 having fifth pivot 46A and sixth pivot 46B is also provided. Fourth pivot 45B and sixth pivot 46B are rotatably mounted on the ends of shafts 35 and 37. Third pivot 45A and fifth pivot 46A are rotatably mounted on second pivot 44B . The total combined distance between fifth pivot 46A and sixth pivot 46B and 45A and fourth pivot 45B is slightly greater than the distance between roll shafts 35 and 37. It can be seen that applying counterclockwise torque to shaft 42 tends to move arm 43 counterclockwise, tending to push link 44 to the right, which in turn acts on links 45 and 46 to apply a spreading force to rolls 11 and 12. Any means for applying torque to shaft 42 is acceptable, such as a pulley fixedly attached to shaft 42 weighted in the counterclockwise direction.

It is desirable to measure the roll pressing forces during the simulated rolling operation. This can be accomplished by mounting a strain gage on thin portion 39B of pivot block 39. Elongation of the thin cross section correlates well with roll pressing force.

Figure 8:
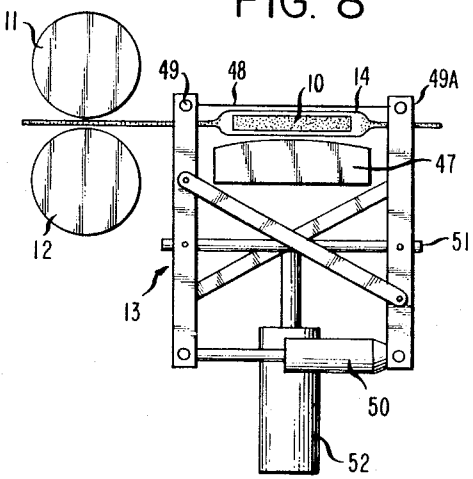
FIGS. 8 and 9 are side views of apparatus for simulating a drying process.

FIG. 8 shows preferred static drying simulation apparatus for use with the invention. It is desirable to simulate a drum drying process wherein a large web of material passes over at least one heated drum. Here drying simulation apparatus 13 has a heated convex surface 47 which serves to simulate the surface of a drum. A band of flexible material 48 mounted in upright arms 49 and 49A is provided. Air cylinder 50 tends to pull the lower part of upright arms 49 and 49A together. The arms pivot on plate 51, keeping material 48 taut. After specimen 10 and carrier 14 have passed through rolls 11 and 12 and into position between surface 47 and material 48, air cylinder 52 is energized to move the entire frame holding material 48 downward so that it presses specimen 10 against surface 47 to simulate drying on a drum. Cylinder 52 can be energized for a time period identical to the time that the specimen would be on a drum in a commercial process.

Figure 9:
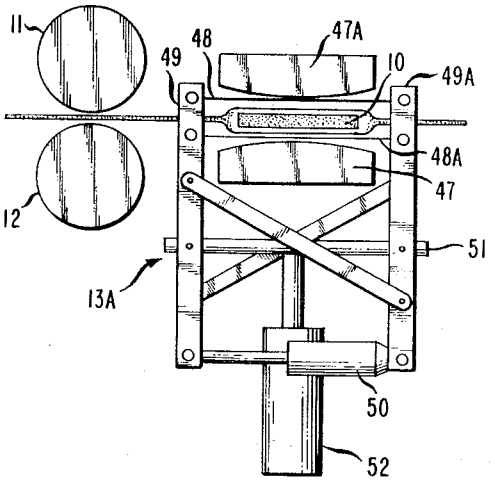

FIG. 9 illustrates drying apparatus that can simulate drying the specimen on a multiple drum dryer wherein both sides of the specimen are exposed to drum surfaces. In FIG. 9, two bands of flexible material 48 and 48A and two convex surfaces 47 and 47A are provided. With the specimen disposed between flexible bands 48 and 48A, as shown, moving frame arms 49 and 49A downward causes the bottom surface of specimen 10 to be dried on surface 47. Upward movement of arms 49 and 49A causes the top surface of specimen 10 to be dried against surface 47A. Alternate up and down movement can simulate a drying operation involving several heated drums.

It can be seen that the present invention achieves a realistic simulation of a rolling and drying operation using only an inexpensive specimen of material.

What is claimed is:

1. Apparatus for simulating a high speed rolling and drying operation comprising:

(a) a specimen of material to be rolled and dried, (b) a pair of rolls having a nip clearance therebetween, said nip clearance being less than the thickness of said specimen so that said rolls make contact with said specimen when said specimen goes through said nip, (c) a low mass carrier for the specimen having a leader and a trailer thinner than the nip of the rolls,
(d) a means for quickly accelerating said carrier to the peripheral speed of the rolls and for pulling said specimen into and through the nip of the rolls,
(e) a static dryer for the specimen,
(f) means for quickly decelerating the specimen and carrier such that the specimen comes to rest inside said dryer for a period of time necessary to accomplish desired drying of the specimen,
(g) means for moving said specimen to a location outside of said dryer after said desired drying period, and
(h) means for continuously applying spreading forces to the rolls to eliminate slack and render roll clearance constant.

2. The apparatus of claim 1 wherein said means for accelerating said carrier comprises a system of pulleys driven by one of the rolls.

3. The apparatus of claim 2 wherein said means for quickly decelerating said carrier comprises means for measuring the movement of said carrier and means for disengaging said pulley system from the roll.

4. The apparatus as defined in claim 1 wherein said rolls are mounted on shafts, each shaft being mounted in a different frame, and wherein the means for continuously applying spreading force comprises:
(a) A shaft rotatably mounted in one of said frames,
(b) an arm having first and second ends fixedly attached to said shaft at said first end,
(c) a first link having first and second pivots, said first pivot rotatably connected to the second end of said arm,
(d) a second link havng third and fourth pivots and a third link having fifth and sixth pivots, the fourth pivot being rotatably mounted on an end of a roll's shaft and the sixth pivot being rotatably mounted on an end of a different roll's shaft, the third and fifth pivots being rotatably mounted on the second pivot, the total distance between the fifth and sixth, and third and fourth pivots being greater than the distance between the roll's shafts, and
(e) means for applying torque to said element (a) shaft so as to apply spreading force to the rolls' shaft.

5. An apparatus as defined in claim 1 wherein the static dryer comprises
(a) a heated convex surface,
(b) a band of flexible material, and
(c) means for selectively moving said flexible material toward said convex surface.

6. The apparatus of claim 5 having first and second oppositely-arranged convex surfaces and first and second bands of flexible material, and wherein said moving means is adapted to alternately move said first band toward said first surface and said second band toward said second surface.

7. A process for simulating a high speed rolling and drying operation comprising:
(a) providing a specimen of material to be rolled and dried,
(b) providing a pair of rolls having a nip clearance therebetween, said nip clearance being less than the thickness of said specimen so that said rolls make contact with said specimen when said specimen goes through said nip,
(c) providing a low mass carrier for the specimen having a leader and a trailer thinner than the nip of the rolls,
(d) quickly accelerating the carrier and specimen to the peripheral speed of the rolls and pulling the specimen into and through the nip of the rolls,
(e) providing a static dryer for the specimen,
(f) quickly decelerating the specimen and carrier such that the specimen comes to rest inside the dryer for a period of time necessary to accomplish desired drying of the specimen,
(g) moving said specimen to a location outside of said dryer after said desired drying period, and
(h) continuously applying spreading forces to the rolls to eliminate slack and render roll clearance constant.

8. The process of claim 7 further comprising:
(f) measuring the roll pressing force during step (b).

* * * * *